US005704084A

United States Patent [19]

Evans et al.

[11] Patent Number: 5,704,084

[45] Date of Patent: Jan. 6, 1998

[54] INFLATABLE MATTRESSES

[75] Inventors: John James Henry Evans, New Milton; Ronald James Peter Evans, Highcliffe; Christopher Peter Evans, New Milton, all of United Kingdom

[73] Assignee: Talley Group Limited, United Kingdom

[21] Appl. No.: 652,513

[22] PCT Filed: Oct. 4, 1994

[86] PCT No.: PCT/GB94/02157

§ 371 Date: Aug. 23, 1996

§ 102(e) Date: Aug. 23, 1996

[87] PCT Pub. No.: WO95/15706

PCT Pub. Date: Jun. 15, 1995

[30] Foreign Application Priority Data

| | | | |
|---|---|---|---|
| Dec. 6, 1993 | [GB] | United Kingdom | 9325062 |
| Dec. 7, 1993 | [GB] | United Kingdom | 9325063 |
| Aug. 19, 1994 | [GB] | United Kingdom | 9416796 |

[51] Int. Cl.[6] ..... A61G 7/057; A47C 27/10

[52] U.S. Cl. ..... 5/710; 5/713

[58] Field of Search ..... 5/713, 714, 712, 5/706, 710, 654, 655.3

[56] References Cited

U.S. PATENT DOCUMENTS

| | | | |
|---|---|---|---|
| 4,686,722 | 8/1987 | Swart | 5/713 |
| 4,838,309 | 6/1989 | Goodwin | 5/713 |
| 4,962,552 | 10/1990 | Hasty | 5/713 |
| 5,022,109 | 6/1991 | Pekar | 5/706 |

FOREIGN PATENT DOCUMENTS

| | | |
|---|---|---|
| 0 122 666 | 10/1984 | European Pat. Off. . |
| 0 261 830 | 3/1988 | European Pat. Off. . |

*Primary Examiner*—Alexander Grosz

*Attorney, Agent, or Firm*—Rhodes, Coats, & Bennett, LLP

[57] ABSTRACT

An inflatable mattress is of an elongated plan form and comprises a plurality of inflatable cells also of an elongated form which are disposed contiguously in a row extending along the longitudinal axis of the mattress. Constraints of a tray-like form circle the cells so as to retain them in a position with their upper ends exposed whereby by the upper ends form a resilient support surface. The cells are formed with pleats so that when a body is placed on the resilient upper surface the support surface material is not tensioned substantially. A cell is of a flexible sheet material and comprises an inner sheet disposed between outer sheets. The outer sheets are secured by spot welds to the inner sheets. Inflation air can flow freely between opposite sides of the inner sheets. The spot welds on each side of a cell define a series of sub-cells. The mattress may be "tuned" so as to change the yield characteristics of a cell. "Tuning" may comprise placing a close-fitting sleeve on a cell so as to embrace it around its longitudinal axis.

19 Claims, 5 Drawing Sheets

INFLATABLE MATTRESSES

BACKGROUND OF THE INVENTION

This invention relates to inflatable mattresses.

Although the invention is primarily concerned with inflatable mattresses to provide yielding support for a recumbent human body, as used herein the term 'mattress' is intended to include resilient cushions, seats and like body-support structures.

A mattress according to the invention may be used to support any form of load, including loads other than a human body.

The invention has particular application to the prevention and treatment of pressure sores, which is a major nursing problem.

EP-A-O 261 830 and EP-A-O 122 666 disclose inflatable mattresses, each comprising a plurality of inflatable cells formed of flexible sheet material disposed side by side in a row, with their upper ends exposed to form resilient support surfaces. In each case restraint means are provided to retain the inflatable cells in place.

The mattress of the present invention distinguishes from the disclosures of these references by providing inflatable cells formed and constructed so that when the mattress is loaded by placing a body on its resilient support surface, the flexible sheet material of the support surface is not subjected to significant tension.

By not subjecting the support surface material to significant tension, 'hammocking' of the support surface material is avoided, and interface pressure between the loading body and the support surface material, which, in the case of a human body gives rise to pressure sores, is limited.

SUMMARIES OF THE INVENTION

According to one aspect of the invention an inflatable mattress comprises a plurality of inflatable cells of elongated plan form, the cells being disposed side by side in a row, constraint means being provided for retaining the cells in position with their upper ends exposed whereby said upper ends form a resilient support surface, characterised in that when each cell is inflated, opposite sides of the cell are recessed at points spaced apart from each other along each side, so as to form pleats, whereby the flexible sheet material of the inflated sells is superfluous when the cells of the mattress are substantially unloaded, and non-superfluous when said cells are substantially loaded.

The invention also resides in a mattress cell per se.

According to another aspect of the present invention, an inflatable mattress comprises a plurality of inflatable cells of elongated plan form, the cells being disposed side by side in a row, first constraint means for retaining the cells in position with their upper ends exposed whereby said upper ends form a resilient surface, and second constraint means embracing at least one of the cells around its longitudinal axis, so as to change the yield characteristic of the cell, so that when a load is applied to the cell, the depth of cell immersion is lower than when said second constraint means is not present.

According to yet another aspect of the present invention, an inflatable mattress comprises a plurality of inflatable cells of elongated plan form, the cells being disposed side by side in a row, first constraint means for retaining the cells in position with their upper ends exposed whereby said upper ends form a resilient surface, and second constraint means embracing at least one of the cells around its longitudinal axis, so as to reduce the height of the cell, where it is embraced by the second constraint means.

The second constraint means allow the inflatable mattress to be 'tuned' to suit the particular requirements of a recumbent body. For example, where the body has a tender heel, use of the second constraint means enables the heel to receive local support.

The second constraint means preferably comprise a sleeve of flexible sheet material which is fitted over the associated cell, before inflation thereof.

BRIEF DESCRIPTION OF THE DRAWINGS

The aspects of the invention will now be described by way of example only, with reference to the accompanying drawings, wherein.

DETAILED DESCRIPTIONS OF THE VARIOUS EMBODIMENTS

Figure 1:
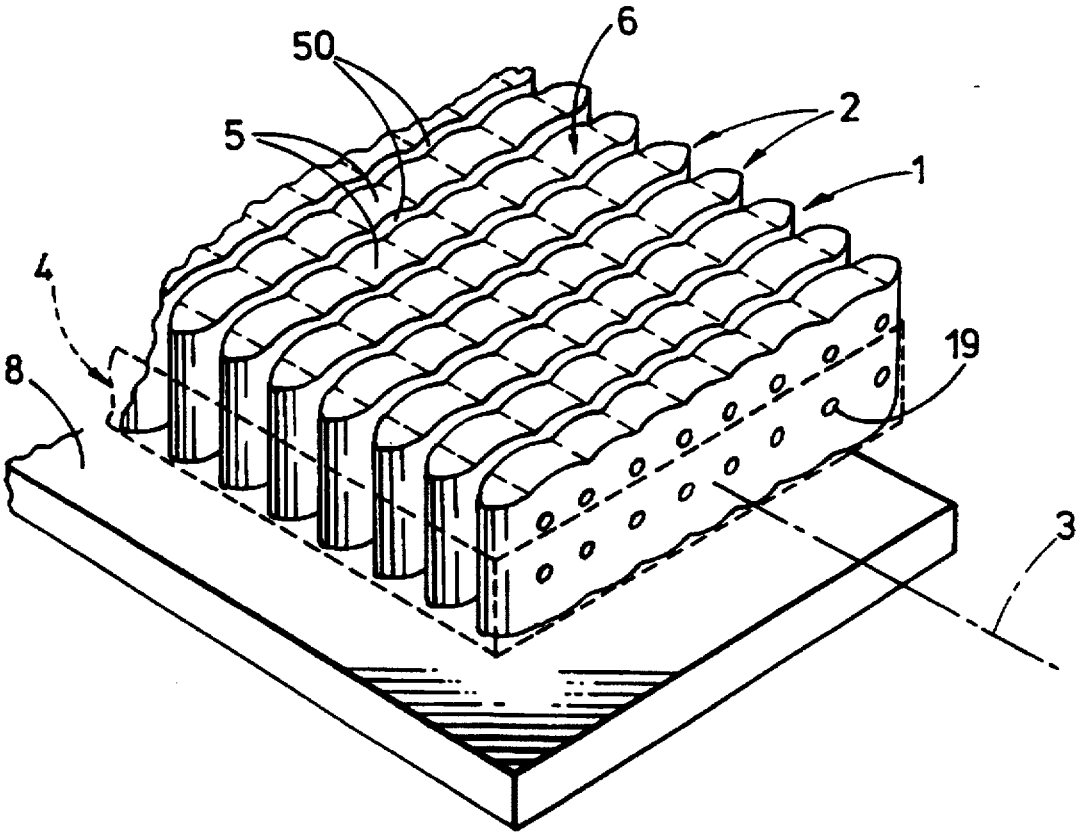
FIG. 1 is a fragmentary view, in perspective of an inflatable mattress according to the first aspect of the invention.
Figure 2:
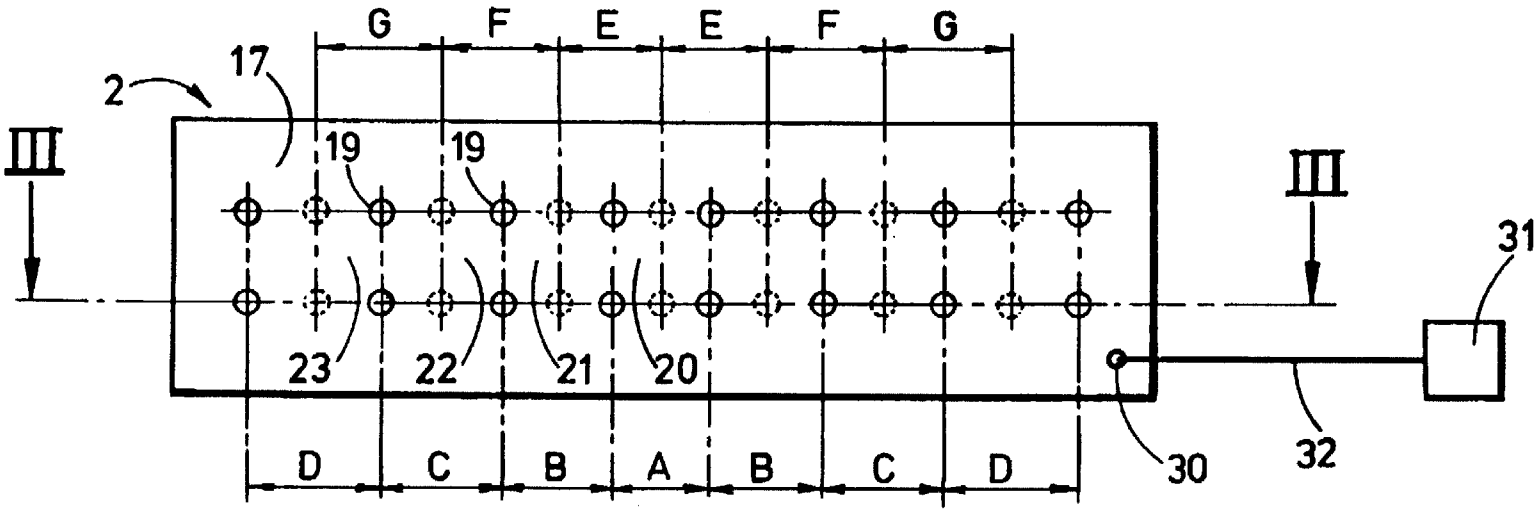
FIG. 2 is a front view of a mattress cell.
Figure 3:
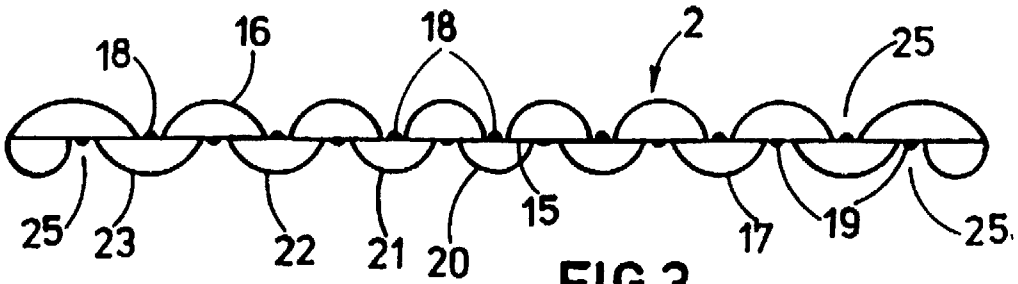
FIG. 3 is a section, taken on the lines III—III of FIG. 2, FIGS. 4, 5 and 6 are semi-diagrammatic end views of the mattress, and illustrate respectively, unloaded, partially loaded and fully loaded conditions.

With reference to FIGS. 1 to 3, an air inflatable mattress 1 is of elongated plan form and comprises a plurality of inflatable cells 2, also of elongated plan form, disposed continuously in a row extending along the longitudinal axis 3 of the mattress, Constraint means 4 encircle the cells so as to retain them in position with their upper ends 5 exposed, whereby said upper ends form a resilient support surface 6.

As explained hereinafter, the cells 2 are formed and constructed so that when a body 7 (FIGS. 5 and 6) is placed on the resilient support surface 6, the support surface material is not tensioned substantially.

The constraint means 4 comprises a tray-like structure of flexible sheet material. The assembly of cells 2 and constraint means 4 are support by a base 8.

The mattress 1 has an oblong plan form. The cells 2 and restraint means 4 are flexible sheet material such as PVC.

With particular reference to FIGS. 2 and 3, a cell 2 comprises an inner sheet 15 disposed between outer sheets 16, 17. The outer sheets 16, 17 are secured by spot welds 18, 19 to the inner sheet 15. Inflation air can flow freely between opposite sides of the inner sheet 15.

The sheet fastenings, ie the spot welds 18, 19 are disposed in longitudinally extending rows, so that the welds on each side of the cell 2 define a series of rectangles, four welds to a rectangle. Each volume bounded by a rectangle comprises a sub-cell. For example, sub-cells 20, 21, 22, 23 on the sheet 17 side of a cell 2.

The group of spot welds on one of the outer sheets, ie 16 or 17, are staggered with respect to those on the other Of the outer sheets, so that the series of rectangles on opposite sides of the cells 2 are staggered or off-set relative to each other.

The dimensions of the rectangles defined by the spot welds differ.

This is shown in FIG. 2, wherein the pitch A of the spot welds 19 defining the rectangle of the central sub-cell 20 is less than pitch B of the spot welds 19 defining the two rectangles of the sub-cells 21 flanking the central sub-cell 20. Spot-weld pitch C is greater than pitch B. Similarly the spot-weld pitch D of the two outermost of the rectangles is greater than pitch C. In the embodiment illustrated, pitches A, B; C and D are, respectively, 4.0 inches, 4.5 inches, 5.0 inches and 5.50 inches (101.60 mm, 114.30 mm, 127.00 mm and 139.70 mm). The spot-weld pitches E, F and G on the outer sheet 16 are, respectively, 4.25 inches, 4.75 inches and 5.25 inches (106.82 mm, 119.52 mm and 132.22 mm).

The presence of the spot-welds 18, 19 creates pleats or tucks 25 when the associated cell 2 is inflated. The pleats 25 extend substantially horizontally across a cell 2 as well as substantially vertically down the sides thereof.

Figure 4:
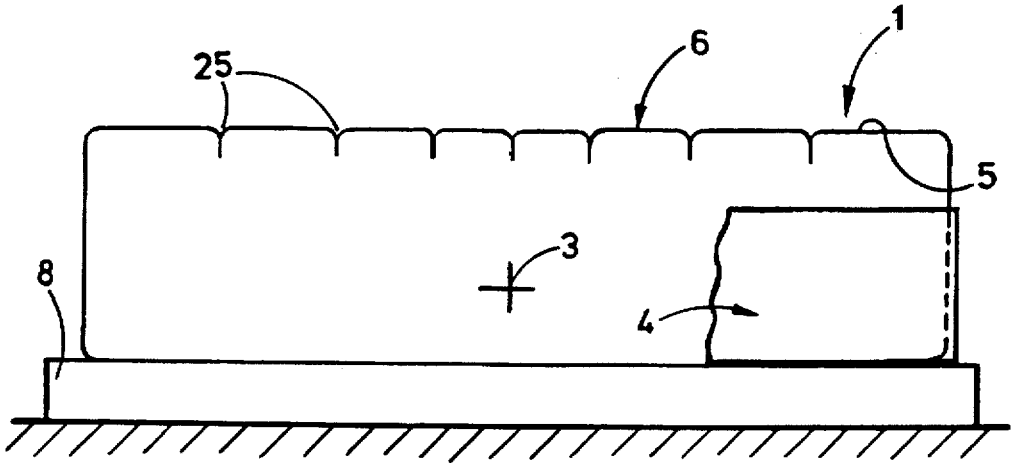

The pleats 25 provide the support surface 6 of the mattress 1 with superfluous material. That is, material, which, when the mattress 2 is unloaded, as shown in FIG. 4, is not required to present a support surface.

When the mattress 2 is unloaded, the support surface 6 can be said to be discontinuous.

Figure 5:
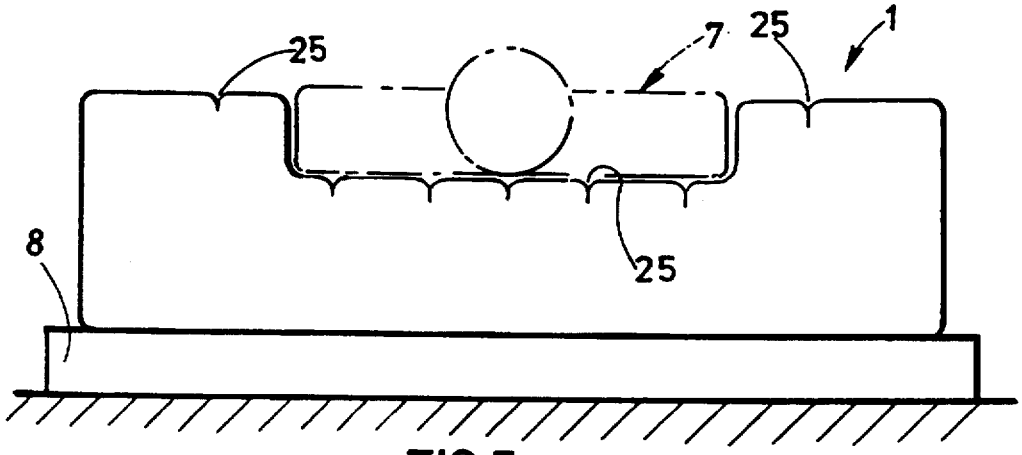

When a human body 7 of medium weight is placed on the support surface 6, as shown in FIG. 5, the portions of the hitherto superfluous material of the inflated cells 2 beneath the body unfolds, reducing the volumes of the associated pleats 25.

The hitherto superfluous cell material now becomes non-superfluous as it augments the original support surface area, preventing it from being subjected to significant tension, thus avoiding 'hammocking'.

Thus the body 7 is not subjected to an interface pressure with the support surface 6, sufficient to give rise to pressure sores. The body 7 immerses into the mattress 1 until air pressure within the cells 2 equalises with the load applied by the body.

Figure 6:
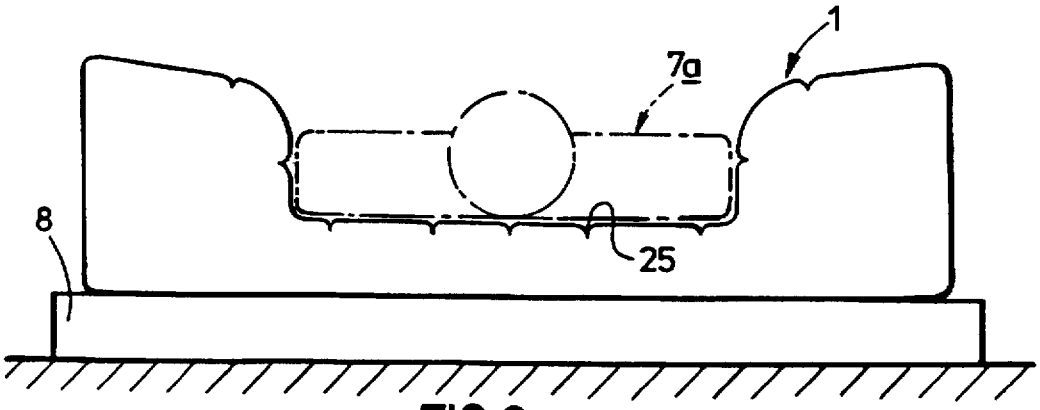

FIG. 6 illustrates how the mattress 1 copes with a human body 7*a*, significantly heavier than body 7, although the same effect can be obtained by retaining body 7 and lowering the cell inflation pressure. Here, the pleats 25 beneath the body 7*a* have almost disappeared, the hitherto superfluous material augmenting the support surface 6 as before.

The depth of immersion of a body into the mattress 1 results in the interface surfaces ie the surface between the body and that part of the mattress providing support, increasing as the depth of body immersion increases.

The mattress 1 spreads the body weight more evenly over a larger area, thus decreasing average interface pressures.

The cells 2 of the mattress 1 are inflated by pressurised air supplied by way of a valved inlet 30 (FIG. 2) connected to a pressure control/air supply unit 31, by a line 32. The unit 31 inflates the cells 2 as may be required. For example, in an alternating inflation pressure sequence.

By attaching the inner sheet 15 of a cell 2 to the outer sheets 16, 17 in the manner described above, the central portion of each inflated cell 2, when viewed from above, is relatively narrow in relation to the outer portions. Thus, on looking down on the support surface 6, each cell 2 appears generally bow-tie shaped (not shown in FIG. 1). Expressed another way, the construction of the cells 2 gives rise to vertically-extending gaps 50 between adjacent cells which gaps are relatively wide at the longitudinal axis 3, but which are progressively narrowed as the sub-cells increase in size in horizontal directions extending away from the axis 3.

By varying the sizes and spacing of the sub-cells 20, etc, the mattress 1 can be adapted to accommodate a wide range of requirements.

The sub-cells 20 etc need not be of rectangular form. They could, for example, be of circular form.

Instead of two or more rows of spot-welds (or other fastenings) on one side of a cell 2, a single row may be provided. The spot-welds/fastenings may be disposed in a non-linear, for example a zig-zag formation.

The inner sheet 15 of a cell 2 could be replaced by other structure. For example, by a plurality of restraint or bracing tapes.

Figure 7:
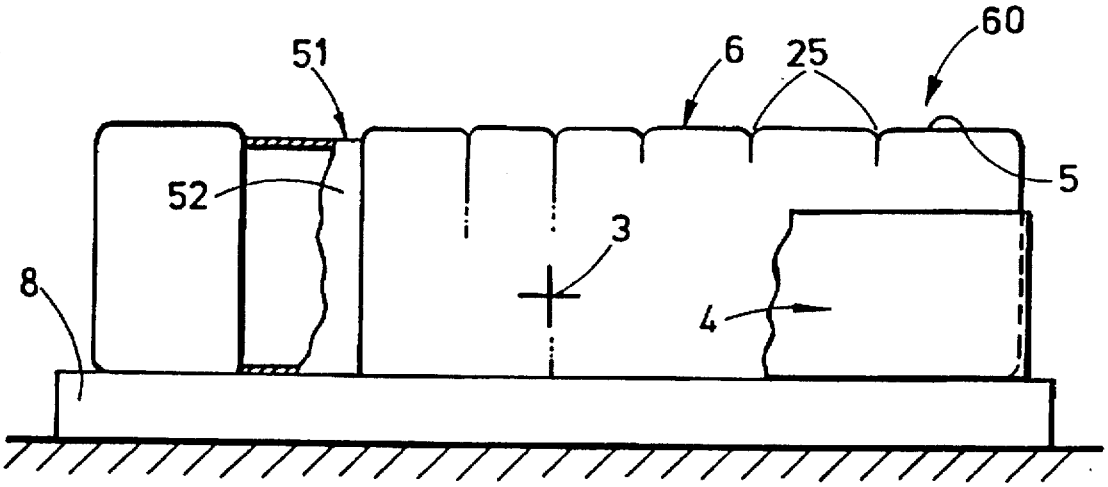
FIG. 7 is a semi-diagrammatic end view of a mattress according to the second aspect of the invention.

The inflatable mattress 60 illustrated by FIG. 7 is identical to the mattress 1 of FIGS. 1 to 6, but with the addition of restraint means 51.

Hereinafter, in order to distinguish one restraint means from another, the restraint means 51 may be referred to as the 'second restraint means', the 'first' restraint means being restraint means 4.

The second restraint means 51 of FIG. 7 comprises a close-fitting sleeve 52 of flexible sheet material which embraces a cell 2.

The tubular sleeve 52 embraces the cell 2 around its longitudinal axis 53, and is sized so as to change the yield characteristic (and amplitude) of the cell, where so embraced, whereby the depth of cell immersion otherwise experienced by a downwardly directed load on the cell is substantially reduced.

Figure 8:
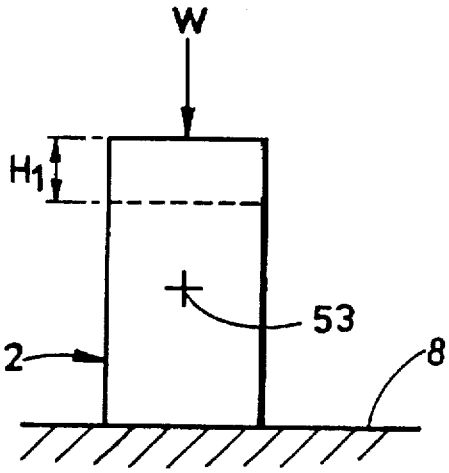
FIGS. 8 and 9 illustrate the change in the yield characteristics obtainable thereby.
Figure 9:
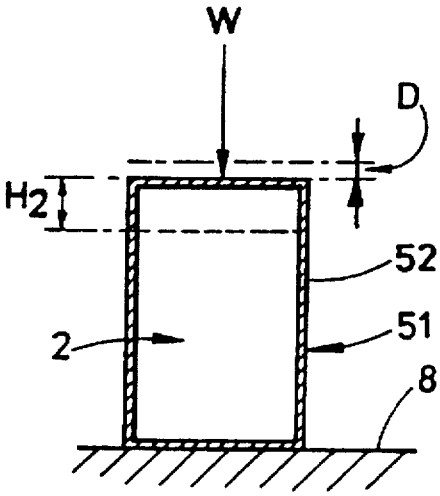
Figure 11:
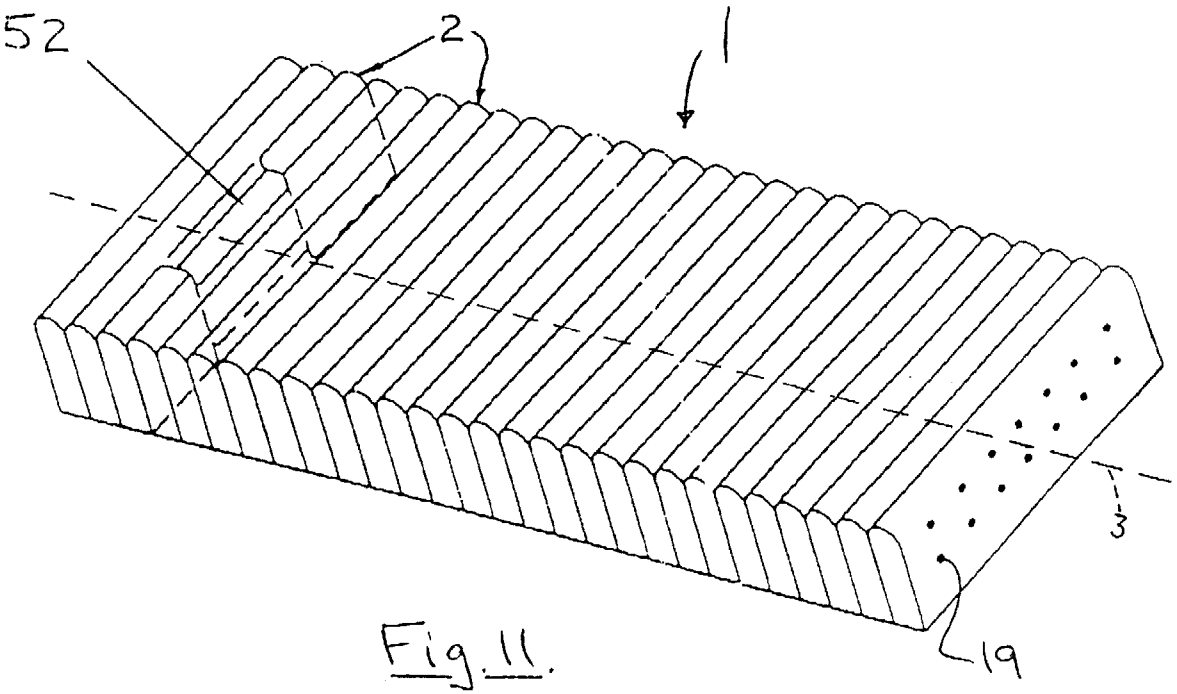
FIG. 11 is a perspective view of the inflatable mattress.
Figure 10:
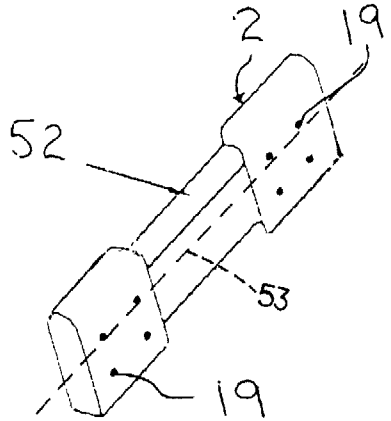
FIG. 10 is a perspective view of a mattress cell.

The yield change characteristic is illustrated by FIGS. 8 and 9.

In FIG. 8, a direct load W imposed on a cell 2 can result in immersion of the load to a depth H1.

In FIG. 9 the cell 2 which is embraced by the close-fitting sleeve 52 is reduced in height by distance D by the constraint imposed by the sleeve. When the same load W is imposed on this constrained cell 2, the depth of cell immersion is H1-D or H2.

Thus the upward thrust provided by the inflated cell is modified, so as to take place within a shorter distance.

The presence of the second constraint means 51 allows the inflatable mattress to be 'tuned' locally, in order to suit the particular requirement of a recumbent body (such a body 7 of FIG. 5). Thus interface pressures resulting from contact of the body with part of the mattress can be varied as desired.

For example, the body may have a tender heel. Suitable placement of the sleeve 52 enables the heel to be supported locally, without the heel having to sink too deeply into the mattress cell 2 before receiving adequate support. In other words, any tendency for a cell 2 to 'bottom' is avoided, without any need for increase of cell inflation pressure. The remainder of the body including, of course, the leg with the tender heel, is supported by the rest of the cells 2, and by the unconstrained part of the cell 2 shown in FIG. 7. There is a marginal rise in the interface pressure at the points of contact between the leg and the leg-supporting cells, and a reduction in interface pressure where the sore heel contacts the constrained cell, the latter having been 'pulled down' in order to reduce interface pressure.

A range of sleeves 52 may be provide. For example, of different lengths and material thickness. The sleeves 52 must be sized so as to reduce the cell height, as shown in FIGS. 7 and 9.

More than one cell 2 may be embraced by a sleeve 52, if this is desired.

The presence of superfluous cell material provided by pleats or tucks 25, (see FIG. 7), does not matter when a sleeve 52 is in place. The cell material is merely crushed-up by the close-fitting sleeve.

Use of second restraint means 51 is not confined to the form of inflatable cell illustrated by FIGS. 1 to 6. This second aspect of the invention is applicable to any inflatable mattress cell which has an elongated plan form.

A sleeve 52 preferably comprises a one-piece tube. However, one could form a sleeve by wrapping a length of flexible sheet material around a cell, securing the sheet in place by removable straps, or the use of 'VELCRO' (Registered Trade Mark) fasteners.

We claim:

1. An inflatable mattress comprising a plurality of inflatable cells of elongated plan form, the cells being formed of flexible sheet material and disposed side by side in a row, constraint means being provided for retaining the cells in position with their upper ends exposed whereby said upper ends form a resilient support surface, the cells also being formed so that, when each cell is inflated, opposite sides of the cell are recessed at points spaced apart from each other along each side, so as to form pleats, the recesses being formed by drawing together said opposite sides of the cell, the flexible sheet material of the inflated cells being superfluous when the cells of the mattress are substantially unloaded, and non-superfluous when said cells are substantially loaded.

2. An inflatable mattress as claimed in claim 1, wherein the recesses on one side of a cell are staggered relative to those on the opposite side of the cell.

3. An inflatable mattress as claimed in claim 1, wherein each inflatable cell comprises an inner sheet disposed between two outer sheets with the outer sheets secured to the inner sheet at said spaced-apart points.

4. An inflatable mattress as claimed in claim 3, wherein said spaced-apart points are disposed in longitudinally-extending rows, so as to define a series of rectangles on each side of a cell.

5. An inflatable mattress as claimed in claim 4, wherein the volume bounded by each rectangle comprises a sub-cell.

6. An inflatable mattress as claimed in claim 4, wherein said rectangles on opposite sides of a cell are offset relative to each other.

7. An inflatable mattress as claimed in claim 6, wherein the sizes of the rectangles on opposite sides of a cell differ in dimensions.

8. An inflatable mattress as claimed in claim 3, wherein said inner sheet comprises tape material.

9. An inflatable mattress as claimed in claim 1, wherein said constraint means comprise a tray-like structure of flexible sheet material.

10. An inflatable mattress as claimed in claim 9, wherein said constraint means and said inflatable cells are supported by a base.

11. An inflatable mattress as claimed in claim 1, wherein each inflatable cell, when viewed from above, has a central portion relatively narrow in relation to its outer portions, so as to provide vertically-extending gaps between adjacent cells.

12. An inflatable mattress as claimed in claim 11, wherein the widths of said vertically-extending gaps are relatively large at the longitudinal axis of the mattress, and are progressively narrow in horizontal directions extending away from said axis.

13. An inflatable mattress as claimed in claim 1, wherein at least one of said inflatable cells is provided with constraint means operable so as to change the yield characteristic of the cell, so that when an external load is applied to the cell, the depth of cell immersion is lower than when such second-mentioned constraint means is not present.

14. An inflatable mattress as claimed in claim 13, wherein said second-mentioned constraint means comprise a close-fitting sleeve of flexible sheet material embracing the cell around its longitudinal axis.

15. An inflatable mattress as claimed in claim 14, wherein said close-fitting sleeve comprises a one-piece tube.

16. An inflatable mattress as claimed in claim 14, wherein said close-fitting sleeve comprises a wrapping of flexible sheet material held in place in a removable manner.

17. An inflatable mattress as claimed in claim 13, wherein a plurality of said second-mentioned constraint mean are provide.

18. An inflatable mattress comprising a plurality of inflatable cells of elongated plan form disposed side by side in a row, first constraint means being provided for retaining the cells in position with their upper ends exposed whereby said upper ends form a resilient surface, and second constraint means embracing at least one of the cells around its longitudinal axis, so as to change the yield characteristic of the cell, so that when an external load is applied to the cell, the depth of cell immersion is lower than when said second constraint means is not present.

19. An inflatable mattress comprising a plurality of inflatable cells of elongated plan form, disposed side by side in a row, first constraint means being provided for retaining the cells in position with their upper ends exposed whereby said upper ends form a resilient surface, and second constraint means are provided for embracing at least one of the cells around its longitudinal axis, so as to reduce the height of the cell, where it is embraced by the second constraint means.

* * * * *